US011851244B2

(12) United States Patent
Beelen

(10) Patent No.: US 11,851,244 B2
(45) Date of Patent: Dec. 26, 2023

(54) RE-CLOSABLE PAPER-BASED PACKAGE

(71) Applicant: The Procter & Gamble Company, Cincinnati, OH (US)

(72) Inventor: Laurens Beelen, Mechelen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/719,507

(22) Filed: Apr. 13, 2022

(65) Prior Publication Data

US 2022/0324617 A1 Oct. 13, 2022

(30) Foreign Application Priority Data

Apr. 13, 2021 (EP) ..... 21167972

(51) Int. Cl.
*B65D 33/20* (2006.01)
*B65D 30/08* (2006.01)
*B65D 33/00* (2006.01)

(52) U.S. Cl.
CPC ..... *B65D 33/20* (2013.01); *B65D 31/02* (2013.01); *B65D 33/007* (2013.01)

(58) Field of Classification Search
CPC ..... B65D 33/20; B65D 31/02; B65D 33/007
USPC ..... 383/211
See application file for complete search history.

(56) References Cited

U.S. PATENT DOCUMENTS 9,682,802 B2 6/2017 Mcdonough
10,118,737 B2 11/2018 Septien Rojas et al.
10,287,063 B2 5/2019 Septien Rojas et al.
2005/0031233 A1* 2/2005 Varanese ..... B65D 33/20 383/211
2008/0105679 A1* 5/2008 Ballard ..... B65D 33/2508 383/65
2016/0122087 A1* 5/2016 Takigawa ..... B65D 33/2508 24/30.5 R (Continued)

FOREIGN PATENT DOCUMENTS

CN 112623488 A * 4/2021
DE 102019132879 A1 * 6/2021

(Continued)

OTHER PUBLICATIONS

Machine translation of CN-112623488-A.*

(Continued)

*Primary Examiner* — Jes F Pascua
(74) *Attorney, Agent, or Firm* — Gary J. Foose

(57) ABSTRACT

A bag including: a first side panel having a pair of first side panel transverse edges and a first side panel interior facing surface; a closure opposite the bottom, wherein the closure releasably connects the first side panel to a second side panel. The closure includes: a first flexible angle. The first flexible angle includes a first interior part joined to the first side panel inside of the interior volume and a first exterior part extending from the first interior part and outside of the interior volume. The closure includes a repositionable pressure sensitive adhesive that releasably engages the first exterior part to the second side panel interior facing surface. A free flange extends from the first exterior part. The free flange is devoid of the repositionable pressure sensitive adhesive. The first side panel and the second side panel are more than about 80% by weight paper.

20 Claims, 8 Drawing Sheets

(56) References Cited

U.S. PATENT DOCUMENTS

| | | | | |
|---|---|---|---|---|
| 2017/0152085 | A1* | 6/2017 | Septien Rojas .... | B65D 33/2541 |
| 2017/0190476 | A1 | 7/2017 | Goto et al. | |
| 2018/0057218 | A1* | 3/2018 | O'Hagan ..... | B65D 33/20 |
| 2019/0315524 | A1 | 10/2019 | Huang | |
| 2020/0198842 | A1 | 6/2020 | Hansen | |
| 2020/0198843 | A1 | 6/2020 | Hansen et al. | |
| 2020/0231340 | A1 | 7/2020 | Septien Rojas | |
| 2020/0239195 | A1 | 7/2020 | Hansen et al. | |
| 2020/0255188 | A1 | 8/2020 | Pawelak | |
| 2021/0284394 | A1 | 9/2021 | Hansen et al. | |
| 2021/0284396 | A1* | 9/2021 | Plourde ..... | C08L 1/28 |

FOREIGN PATENT DOCUMENTS

| | | | |
|---|---|---|---|
| GB | 300470 | A | 11/1928 |
| GB | 916266 | A | 1/1963 |
| GB | 1354481 | A | 6/1974 |
| JP | 2000118536 | A | 4/2000 |
| WO | 9850279 | A2 | 11/1998 |
| WO | 2014045777 | A1 | 3/2014 |
| WO | 2015031811 | A1 | 3/2015 |
| WO | 2016202865 | A1 | 12/2016 |
| WO | 2019148454 | A1 | 8/2019 |
| WO | 2022087038 | A1 | 4/2022 |

OTHER PUBLICATIONS

Machine translation of DE-102019132879-A1.*

PCT Search Report and Written Opinion for PCT/US2022/024333 dated Jul. 20, 2022, 12 pages.

Extended EP Search Report and Written Opinion for 21167972.5 dated Sep. 16, 2021, 07 pages.

All Office Actions; U.S. Appl. No. 17/963,709, filed Oct. 11, 2022.

Unpublished U.S. Appl. No. 17/963,709, filed Oct. 11, 2022, to Laurens Beelen.

* cited by examiner

RE-CLOSABLE PAPER-BASED PACKAGE

FIELD OF THE INVENTION

BACKGROUND OF THE INVENTION

Re-closable recyclable packages are desirable to consumers. Rigid recyclable packages made of paperboard, corrugated paperboard, glass, and plastic can meet such a desire. For certain types of products, rigid packages may not be desirable for a multitude of reasons.

Many products are packaged in flexible plastic film bags. Flexible plastic film bags may be lightweight, durable, and inexpensive. Plastic film bags can be provided with a mechanism to reclose the bag after first opening the package. For example, dry food bags are commonly re-closeable with a twist tie. Some products, including soluble unit dose laundry and dish products, are sold in flexible plastic film bags that include an interlocking closure. Common interlocking closure mechanisms include slide-seals in which a sliding mechanism includes a plow to push apart a tongue-in-groove connection when opening and a guide to reclose the connection. Press seal interlocking closure mechanisms such as VELCRO, a tongue-in-groove connection, interlocking knobs, and the like that than can be directly opened and closed by the user's fingers are also common. Like the flexible plastic film bags, the closure mechanisms are commonly constructed of plastic materials since plastic materials have the requisite combination of flexibility to allow interlocking mechanisms to interlock and stiffness to resist unintentional opening.

Some consumers may have inconvenient access to a deposit point of the recycling stream for plastic film bags. With this limitation in mind, there is a continued unaddressed need for re-closable bags that consumers can conveniently deposit into a recycling stream.

SUMMARY OF THE INVENTION

A bag comprising: a first side panel having a pair of first side panel transverse edges and a first side panel interior facing surface; a second side panel opposite the first side panel and having a second side panel interior facing surface facing the first side panel interior facing surface, wherein the second side panel is connected with the first side panel across a bottom of the bag and has a pair of second side panel transverse edges, wherein each of the first side panel transverse edge is joined to an opposing second side panel transverse edge; a closure opposite the bottom and extending along a longitudinal axis, wherein the closure releasably connects the first side panel and the second side panel, wherein the closure, part of the first side panel interior facing surface, part of the second side panel interior facing surface, and the bottom define an interior volume; wherein the closure comprises: a first flexible angle extending along the longitudinal axis, wherein the first flexible angle comprises a first interior part joined to the first side panel inside of the interior volume and a first exterior part extending from the first interior part and outside of the interior volume; a repositionable pressure sensitive adhesive that releasably engages directly or indirectly the first exterior part to the second side panel interior facing surface; a free flange extending from the first exterior part and along at least a portion of the longitudinal axis, wherein the free flange is devoid of the repositionable pressure sensitive adhesive; wherein the first side panel and the second side panel are more than about 80% by weight paper. Optionally, the bag further comprises a second flexible angle extending along the longitudinal axis, wherein the second flexible angle comprises a second exterior part joined to the second side panel interior facing surface outside of the interior volume and a second interior part extending from the second exterior part and inside the interior volume, wherein the repositionable pressure sensitive adhesive releasably engages the first exterior part to the second interior part to indirectly releasably engage the first exterior part to the second side panel interior facing surface through the second interior part, and wherein the second interior part has a second interior part distal end oriented towards the interior volume.

DETAILED DESCRIPTION OF THE INVENTION

The term "joined to" encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined to" encompasses configurations in which an element is secured to another element at selected locations, as well as configurations in which an element is completely secured to another element across the entire surface of one of the elements. The term "joined to" includes any known manner in which elements can be secured.

The recycling stream for paper products is readily available to many consumers. Hence, paper packaging may be conveniently deposited into the recycling stream by consumers. Many consumers view bags as a preferred package for consumer goods. Bags have many advantages over rigid packages including, but not limited to, being lightweight, durable, and inexpensive. In particular, paper based bags present an opportunity for meeting an unmet consumer desire for being able to deposit paper bags in the paper recycling stream.

For many products that are packaged in bags, consumers and manufacturers desire to have a closure mechanism that can be easily opened and securely closed. This can be especially true for bags that contain multiple single-use products that the consumer occasionally retrieves for use and the remaining single-use products are stored in the bag for use in the future.

Figure 1:
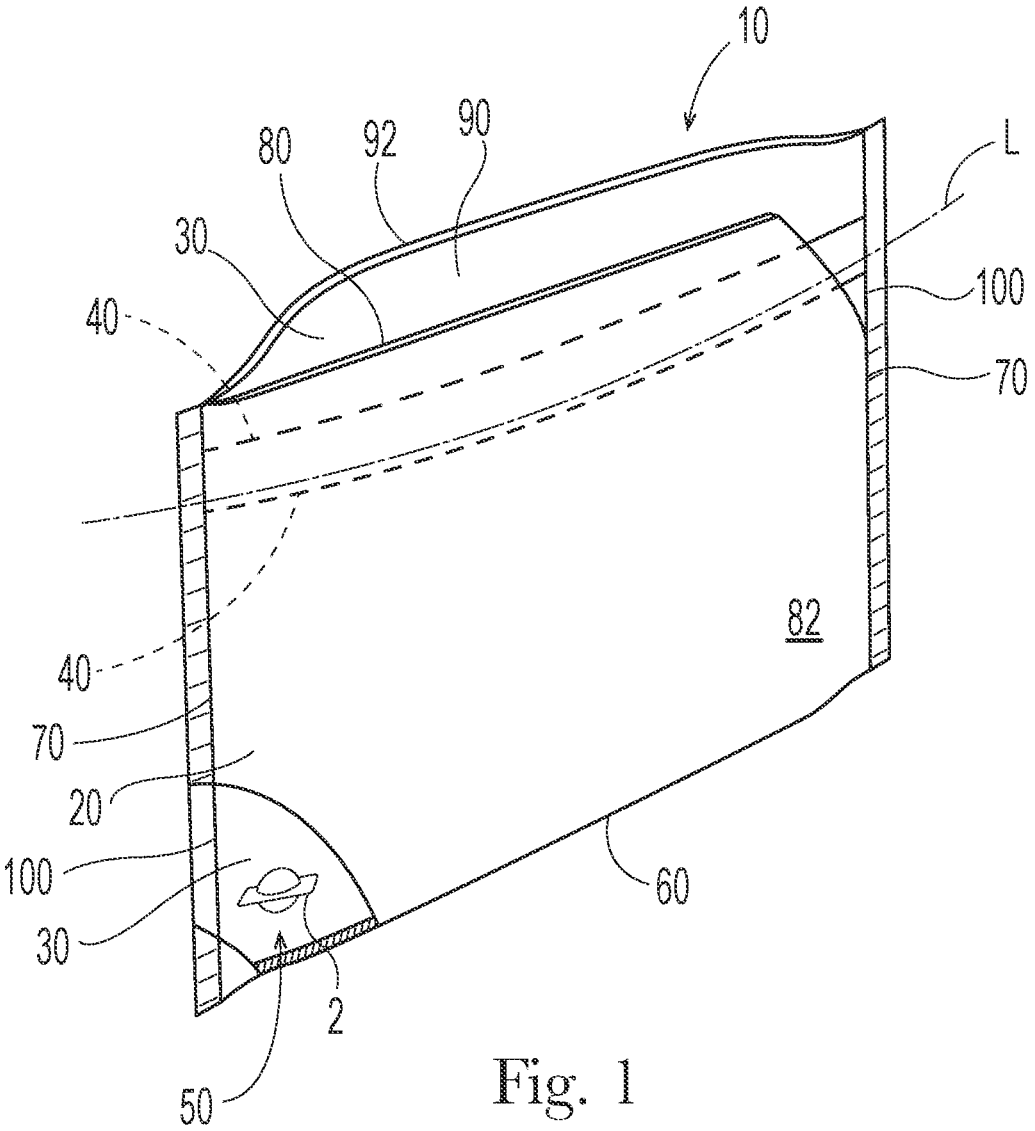
FIG. 1 is a perspective view of a bag.

A bag 10 is shown in FIG. 1. The bag 10 can comprise a first side panel 20, a second side panel 30, and a closure 40. The second side panel 30 can be connected with the first side panel 20 across the bottom 60 of the bag 10. The first side panel 20 and second side panel 30 can be separate pieces that are joined to one another at the bottom 60 of the bag 10. Optionally, the first side panel 20 and the second side panel 30 can be continuous. For example, the first side panel 20 and the second side panel 30 can be formed from a single substrate that is folded at the bottom 60. Together, part of the first side panel 20, part of second side panel 30, and the closure 40 can define an interior volume 50. The interior volume 50 can contain a plurality of articles 2. The first side panel 20 can be continuous with the second side panel 30 across the bottom 60 of the bag 10.

The first side panel 20 can have a pair of first side panel transverse edges 70 and a first side panel interior facing surface 80. The second side panel 30 can be opposite the first side panel 20 and can have a second side panel interior facing surface 90 facing the first side panel interior facing surface 80. The second side panel 30 can have a pair of second side panel transverse edges 100. Each of the first side panel transverse edges 70 can be joined to an opposing second side panel transverse edge 100.

The first side panel 20 can have a first side panel exterior facing surface 82 opposite the first side panel interior facing surface 80. Likewise, the second side panel can have a second side panel exterior facing surface 92 opposite the second side panel interior facing surface 90.

The bottom 60 of the bag 10 can be configured in a variety of ways. For instance the bottom 60 can be formed by joining the first side panel 20 and the second side panel 30 at the bottom. The first side panel 20 and second side panel 30 can be formed from a single continuous substrate that is folded twice at the bottom 60 to form a flat bottom 60 of the bag 10. Gussets and seals can be employed in one or both of the first side panel 20 and second side panel 30 to provide for the desired shape of the bottom 60 of the bag 10. Moreover, gussets and seals can be employed at the transverse edges of the first side panel 20 and second side panel 30 proximal the bottom 60 to provide for the desired shape of the bottom 60 of the bag 10. Gussets and seals can likewise be employed at other locations along the transverse edges of the first side panel 20 and second side panel 30 to provide for the desired shape of the transverse edges of the bag 10 when the bag 10 is filled.

Figure 2:
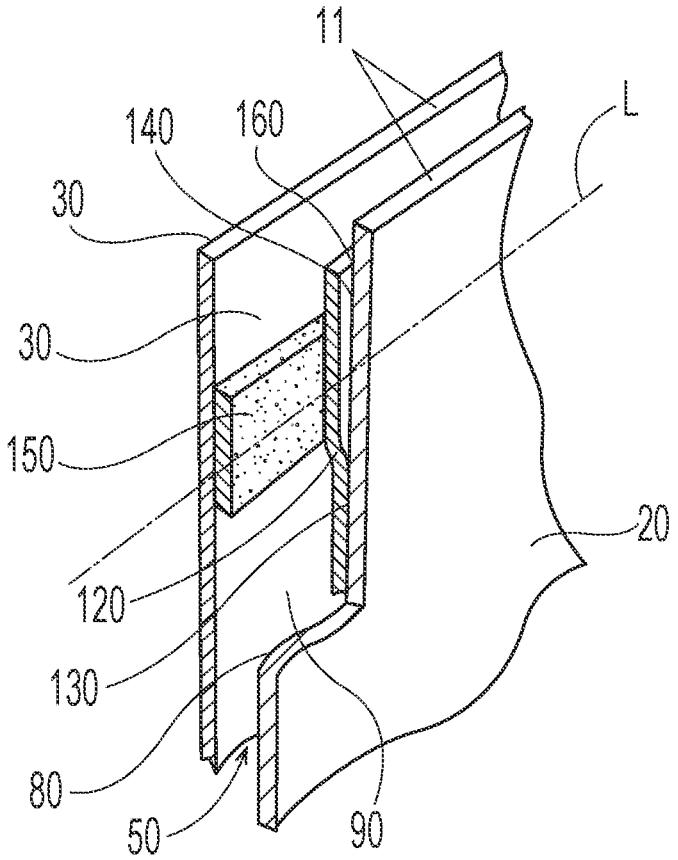
FIG. 2 is a perspective view of a cross section of the top part of a bag.

The closure 40 can be opposite the bottom 60 and extend along a longitudinal axis L. The longitudinal axis L can extend from one first side panel transverse edge 70 and second side panel transverse edge 100 to the opposing first side panel transverse edge 70 and second side panel transverse edge 100. The closure releasably connects the first side panel 20 and the second side panel 30. The closure 40 can comprise a first flexible angle 120 extending along the longitudinal axis L (FIG. 2). The first flexible angle 120 can comprise a first interior part 130 joined to the first side panel 20 inside of the interior volume 50. The first flexible angle 120 can comprise a first interior part 130 joined to the first side panel interior facing surface 80. The first flexible angle 120 can comprise a first exterior part 140 extending from the first interior part 130 and outside the interior volume 50. The first flexible angle 120 can be flexible about the location from which the first exterior part 140 extends from the first interior part 130. The first exterior part 140 can be reciprocatingly pivotable about the location from which the first exterior part 140 extends from the first interior part 130. The first interior part 130 is the part of the first flexible angle 120 that is joined to the first panel interior facing surface 80. The first exterior part 140 is referred to as exterior since the first exterior part 140 is outside the interior volume 50 and the contents of the bag 10 may not contact the first exterior part 140 when the closure 40 of the bag 10 is closed.

The closure 40 can comprise a repositionable pressure sensitive adhesive 150 releasably engaging the first exterior part 140 to the second side panel interior facing surface 90. Arranged as such, the interior volume 50 of the bag 10 can be closed off from the exterior environment and the bag can be opened by disengaging, for example by peeling, the first exterior part 140 from the second side panel interior facing surface 90. For the arrangement shown in FIG. 2, the interior volume 50 is defined by part of the first side panel 20, part of the second side panel 30, and the first interior part 130. The first interior part 130 is referred to as interior since the first interior part 130 defines part of the interior volume 50 and the contents of the bag 10 may contact the first interior part 130 when the bag 10 is unopened. The repositionable pressure sensitive adhesive 150 can be releasably engaged with one of the second side panel interior facing surface 90 and the first exterior part 140. Optionally, adhesive 150 can be applied to both the second side panel interior facing surface 90 and the first exterior part 140 oriented towards the second side panel interior facing surface 90.

The closure 40 can further comprise a free flange 160 extending from the first exterior part 140 along at least a portion of or entirely along the longitudinal axis L. The free flange 160 can be devoid of the repositionable pressure sensitive adhesive 150. Arranged as such, the free flange 160 can provide for a longitudinally extensive flange that the user of the bag 10 can pinch against the first side panel interior facing surface 80 between the user's thumb and index finger of one hand to peel the first exterior part 140 and the second side panel 30 away from one another by gripping the second side panel 30 with the other hand. Optionally, the free flange 160 can be peeled away from the second side panel 30 by pulling one or the other or both away from the other to peel the free flange 160 and the second side panel 30 away from one another. The first side panel 20 can comprise a thicker caliper substrate than the free flange 160 so that the first side panel 20 is more rigid than the free flange 160. Such an arrangement can provide for a more substantial surface against which to pinch the free flange 160 and for the user's opposing digit to pinch up against the first side panel 20. The repositionable pressure sensitive adhesive 150 can resist the separation of the first exterior part 140 from the second side panel 30 so that the bag 10 tends to remain closed unless deliberative effort is applied to open the bag 10. The free flange 160 can be a flexible and or slick material that is challenging to securely pinch between the user's thumb and index finger. That can reduce the potential for opening the bag 10 by just grasping the free flange 160 and peeling the first exterior part 140 away from the second side panel interior facing surface 90. The free flange 160 can be coated with slick coating so that the free flange 160 cannot be easily grasped or pinched against the first side panel interior facing surface 80.

The free flange 160, first exterior part 140, and first interior part 130 can be a continuous substrate. That is, the free flange 160, first exterior part 140, and first interior part 130 can be formed of a single piece of substrate. The part of the substrate joined to the first side panel 20 can be the first interior part 130. The part of the substrate extending from the first interior part 130 that is engaged with the repositionable pressure sensitive adhesive 150 can be the first exterior part 140. The free flange 160 can be reciprocatingly pivotable about the location from which the free flange 160 extends from the first exterior part 140.

The free flange 160 can be recessed relative the top edges 11 of the first side panel 20 and second side panel 30. The top edges 11 are opposite the bottom 60. That can require the user of the bag 10 to be more deliberate to seek out the free flange 160 so that the bag 10 can be opened. The bag 10 can be opened by gripping the free flange 160 in some manner and applying a peeling force to the first exterior part 140 with one hand to peel the first exterior part 140 away from the repositionable pressure sensitive adhesive 150 joined to the second panel 30 which may be held with the other hand. Optionally, the repositionable pressure sensitive adhesive 150 can be joined to the first exterior part 140 and the bag 10 can be opened by peeling the first exterior part 140 and repositionable pressure sensitive adhesive 150 with one hand away from second panel 30 held with the other hand. The repositionable pressure sensitive adhesive 150 can be on a surface selected from the second panel 30, the first exterior part 140, and combinations thereof.

The repositionable pressure sensitive adhesive 150 can comprise a backing layer and an adhesive composition. The adhesive composition can be carried on the backing layer. The backing layer can be joined to the first exterior part 140. In such an arrangement, the adhesive composition can releasably engage with the second side panel interior facing surface 90. The backing layer can be joined to the second side panel interior facing surface 90. In such arrangement, the adhesive composition can releasably engage with the first exterior part 140. Optionally, the repositionable pressure sensitive adhesive 150 can be a melding of adhesive composition with some of the adhesive composition being carried on a backing layer joined to the first exterior part 140 and some of the adhesive composition being carried on a backing layer joined to the second side panel interior facing surface 90. Such an arrangement is analogous to two lengths of single sided adhesive tape being stuck together with the adhesive sides of each length of tape facing one another.

In an arrangement in which the first exterior part 140 is directly engaged with the second side panel interior facing surface 90, if the closed bag 10 is inverted, the closure 40 can resist the contents of the bag 10 from spilling out by way of the peeling resistance between repositionable pressure sensitive adhesive 150 and the element to which the repositionable pressure sensitive adhesive 150 is releasably engaged. The peeling force can arise from the lateral pressure of the contents of the bag 10 pressing outwardly on the first side panel 20 and second side panel 30 and from the weight of the contents of the bag 10 on the closure 40.

The free flange 160 can have a free flange length along the longitudinal axis L. The free flange length can be less than or equal to the closure length. The closure length and the free flange length can be measured along the longitudinal axis L. The closure length and free flange length are scalar quantities. The closure length is a measure of the length of the part of the closure 40 that is intended to be opened and re-closed. The free flange length is the length of the free flange along the longitudinal axis L. The closure length can be the length from one first side panel transverse edge 70 and second side panel transverse edge 100 to the opposing first side panel transverse edge 70 and second side panel transverse edge 100.

The free flange length can be the same as the closure length. In such an arrangement, the user can grasp or pinch the free flange 160 at any location along the longitudinal axis L to open the package, for example by applying a peeling force to the free flange 160 with one hand to peel the first exterior part 140 and the second side panel interior facing surface 90 held with the other hand apart from one another. This can make the bag 10 more easily opened than if the free flange 160 is shorter. For example, the free flange length can be less than about 20%, optionally less than about 10%, optionally less than about 5%, of the closure length. Such an arrangement can challenge the user to find the free flange 160 so that the bag 10 can be easily opened. The free flange 160 can be located at or near the midpoint of the closure 40 along the longitudinal axis L. Optionally, the free flange 160 can be located nearer to the transverse edges of the bag 10 than the midpoint of the closure 40 along the longitudinal axis L. The free flange 160 can have a length along the longitudinal axis L from about 10 mm to about 40 mm, optionally about 15 mm to about 30 mm.

Figure 3:
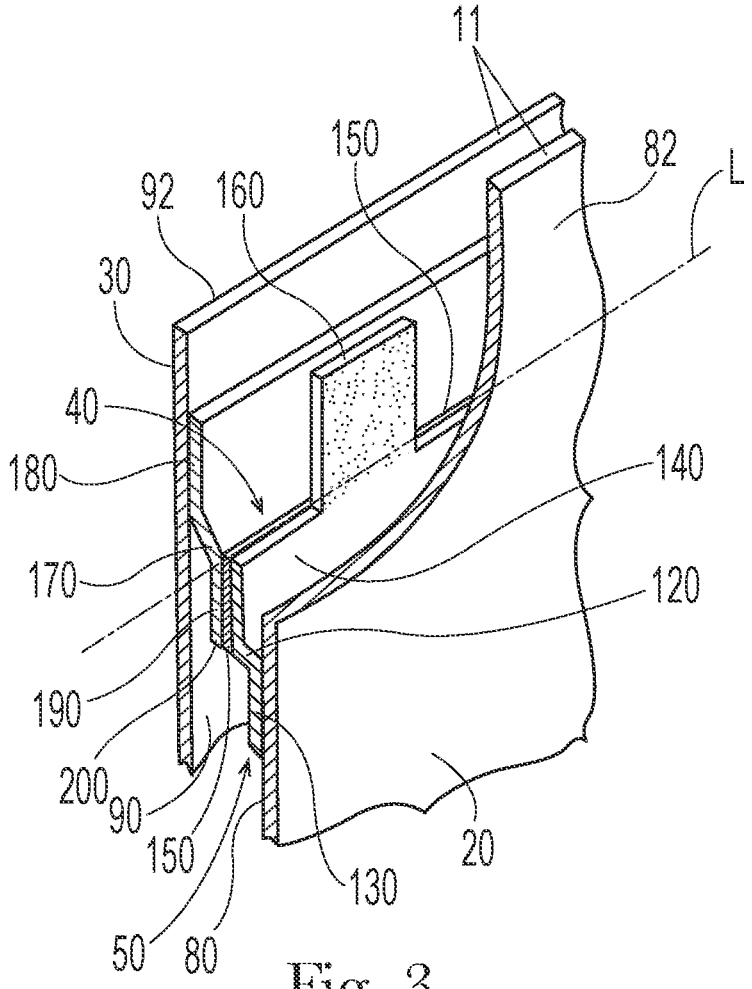
FIG. 3 is a perspective view of a cross section of the top part of a bag.

Optionally, the closure 40 can comprise two free flanges 160. Optionally, one of the free flanges 160 can be located nearer to one set of the transverse edges of the bag 10 than the midpoint of the closure 40 along the longitudinal axis L and the other free flange 160 can located nearer to the opposite set of transverse edges of the bag 10 than the midpoint of the closure 40 along the longitudinal axis L. In this arrangement, the closure 40 can have two free flanges 160, each of which is near one set of transverse edges than a midpoint of the closure 40 along the longitudinal axis L. That is, the two free flanges 160 can be located towards, at, proximal, or near opposite ends of the closure 40. Such an arrangement can provide for ambidextrous opening of the bag 10 in that at least one free flange 160 is located at a set of transverse edges that users may tend to orient away from their body when opening the bag 10. The bag 10 can comprise a second flexible angle 170 to provide for a closure 40 that has another mechanism, as compared to the bag shown in FIG. 2, for resisting opening when the closed bag 10 is inverted and the contents of the bag 10 exert lateral pressure on the first side panel 20 and second side panel 30 (FIG. 3). Like the first flexible angle 120, the second flexible angle 170 can extend along the longitudinal axis L. The second flexible angle 170 can comprise a second exterior part 180 joined to the second side panel interior facing surface 90 outside the interior volume 50. The second flexible angle 170 can comprise a second interior part 190 extending from the second exterior part 180 and inside the interior volume 50. The repositionable pressure sensitive adhesive 150 can releasably engage the first exterior part 140 to the second interior part 190 to indirectly releasably engage the first exterior part 140 with the second side panel interior facing surface 90 through the second interior part 190. The second interior part 190 can have a second interior part distal end 200 oriented towards the interior volume 50. The second interior part 190 is referred to as interior since the second interior part 190 can define or form part of the interior volume 50 and the contents of the bag 10 may contact the second interior part 190 when the bag 10 is closed. For the arrangement shown in FIG. 3, the interior volume 50 is defined by part of the first side panel 20, part of the second side panel 30, the first interior part 130, and the second interior part 190.

The second flexible angle 170 can be flexible about the location from which the second interior part 190 extends from the second exterior part 180. The second interior part 190 can be reciprocatingly pivotable about the location from which the second interior part 190 extends from the second exterior part 180. The second exterior part 180 is the part of the second flexible angle 170 that is joined to the second panel interior facing surface 90. The second flexible angle 170 can be a continuous substrate. That is, the second flexible angle 170 can be formed of a single piece of substrate.

The repositionable pressure sensitive adhesive 150 can comprise a backing layer and an adhesive composition. The adhesive composition can be carried on the backing layer. The backing layer can be joined to the first exterior part 140. In such an arrangement, the adhesive composition can releasably engage with the second interior part 190. The backing layer can be joined to the second interior part 190. In such arrangement, the adhesive composition can releasably engage with the first exterior part 140. Optionally, the repositionable pressure sensitive adhesive 150 can be a melding of adhesive composition 150 with some of the adhesive composition 150 being carried on a backing layer joined to the first exterior part 140 and some of the adhesive composition 150 being carried on a backing layer joined to the second interior part 190. Such an arrangement is analogous to two lengths of single sided adhesive tape being stuck together with the adhesive sides of each length of tape facing one another.

The repositionable pressure sensitive adhesive 150 can be positioned on a surface selected from the first exterior part 140 oriented towards the second interior part 190, the second interior part 190 and oriented towards the first exterior part 140, and combinations thereof. The repositionable pressure sensitive adhesive 150 can be provided on a backing layer that is joined to the respective part.

In an arrangement in which a second flexible angle 170 is included, the bag can be opened in a manner similar to that described above in which the free flange 160 may be employed to peel the first exterior part 140 and the second side panel interior facing surface 90 away from one another, with the difference being that the free flange 160 is used to generate a peeling force to peel the first exterior part 140 and the second interior part 190 away from one another. In FIG. 3, the free flange 160 has a free flange length that is shorter than the closure length. In such an arrangement the free flange 160 can be a tab that the user can manipulate to impart the necessary forces to peel apart the closure 40. Providing a relatively short free flange 160 can necessitate the user to expend considerable cognitive effort to identify the flange 160 and determine how to manipulate the flange 160 to open the closure 40.

A least a portion of the free flange 160 can contrast in color with the first exterior part 140. Such an arrangement can help the user find the free flange 160 to open the closure. If the free flange 160 has a short free flange length, providing the free flange 160 with a color that contrasts with other parts of the closure can be particularly practical since there may only be a small tab for the user to use to peel the closure 40 apart.

Figure 4:
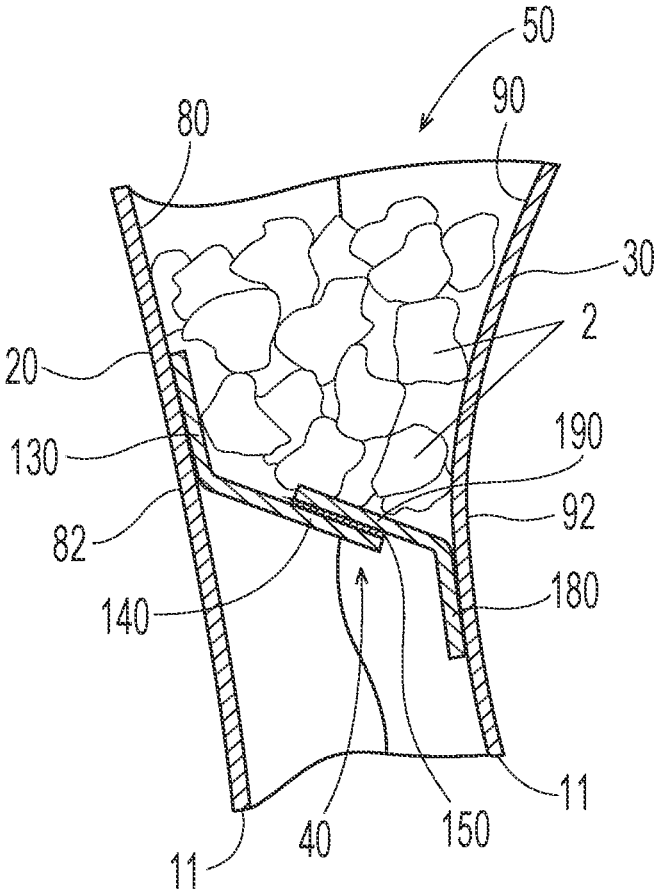
FIG. 4 is a cross section of a bag containing articles that is turned upside.

A bag 10 that includes a closure 40 that comprises a first flexible angle 120 and a second flexible angle 170 can be suitable for retaining the contents of the bag 10 when the bag 10 is inverted. When the bag 10 is in an upright position with closure 40 oriented upwardly, the first exterior part 140 and the second interior part 190 will tend to be aligned vertically, notwithstanding minor variations in orientation arising from bulging and wrinkling of the bag 10 and the accompanying deformations of the closure 40. When the bag 10 is inverted, the contents of the bag 10 will rest on the closure 40 and the lateral pressure of the contents of the bag 10 will tend to push apart the first side panel 20 and the second side panel 30 (FIG. 4). By way of the first flexible angle 120 and the second flexible angle 170, the first exterior part 140 and the second interior part 190 will tend to counter rotate relative to the first interior part 130 and second exterior part 180, respectively, and connect the first interior part 130 and the second exterior part 180 in a somewhat straight line or a sagged line. That is, the first exterior part 140 can pivot about the location from which the first exterior part 140 extends from the first interior part 120 and the second interior part 190 can pivot about the location from which the second interior part 190 extends from the second exterior part 180.

When the bag 10 is inverted, the closure 40 can remain closed by the connection between the first exterior part 140 and the second interior part 190 that is provided by the repositionable pressure sensitive adhesive 150. The shear strength of the repositionable pressure sensitive adhesive 150 and the shear strength of the connection between the repositionable pressure sensitive adhesive 150 and the surface, or opposing repositionable pressure sensitive adhesive 150, to which the repositionable pressure sensitive adhesive 150 is releasably engaged resist separation of the first exterior part 140 and the second interior part 190 by shearing movement of the parts relative to one another.

In general, repositionable pressure sensitive adhesive 150 tends to be stronger when a pure normal force or pure shear force is applied compared to a peeling force. Peeling forces are applied locally at the peeling interface and hence tend to generate locally high normal and or shear stresses at the peeling interface. Pure normal force and pure shear force are applied over a larger area than peeling forces and hence tend to generate comparatively lower normal and shear stresses. In a peeling mode of separation, most if not all of the force is applied at the peeling interface or proximal thereto, which has a limited area or volume over or through which the force may be conveyed as stress, thereby creating locally high normal and or shear stresses.

When a bag 10 that includes a closure 40 that comprises a first flexible angle 120 and a second flexible angle 170 is in the upright position, as shown in FIG. 3, the user can grip the free flange 160 to apply a peeling force at the interface of the first exterior part 140 and the second interior part 190. The peel strength of the repositionable pressure sensitive adhesive 150 governs the ease or difficulty that the user experiences when peeling the first exterior part 140 and the second interior part 190 away from one another.

When a closed bag 10 is inverted, as shown in FIG. 4, the repositionable pressure sensitive adhesive 150 connecting the first exterior part 140 and the second interior part 190 is loaded predominantly in shear. As such, the first exterior part 140 and the second interior part 190 are strongly connected to one another and the articles 2 in the interior volume 50 of the bag 10 may not spill from the bag 10.

Figure 5:
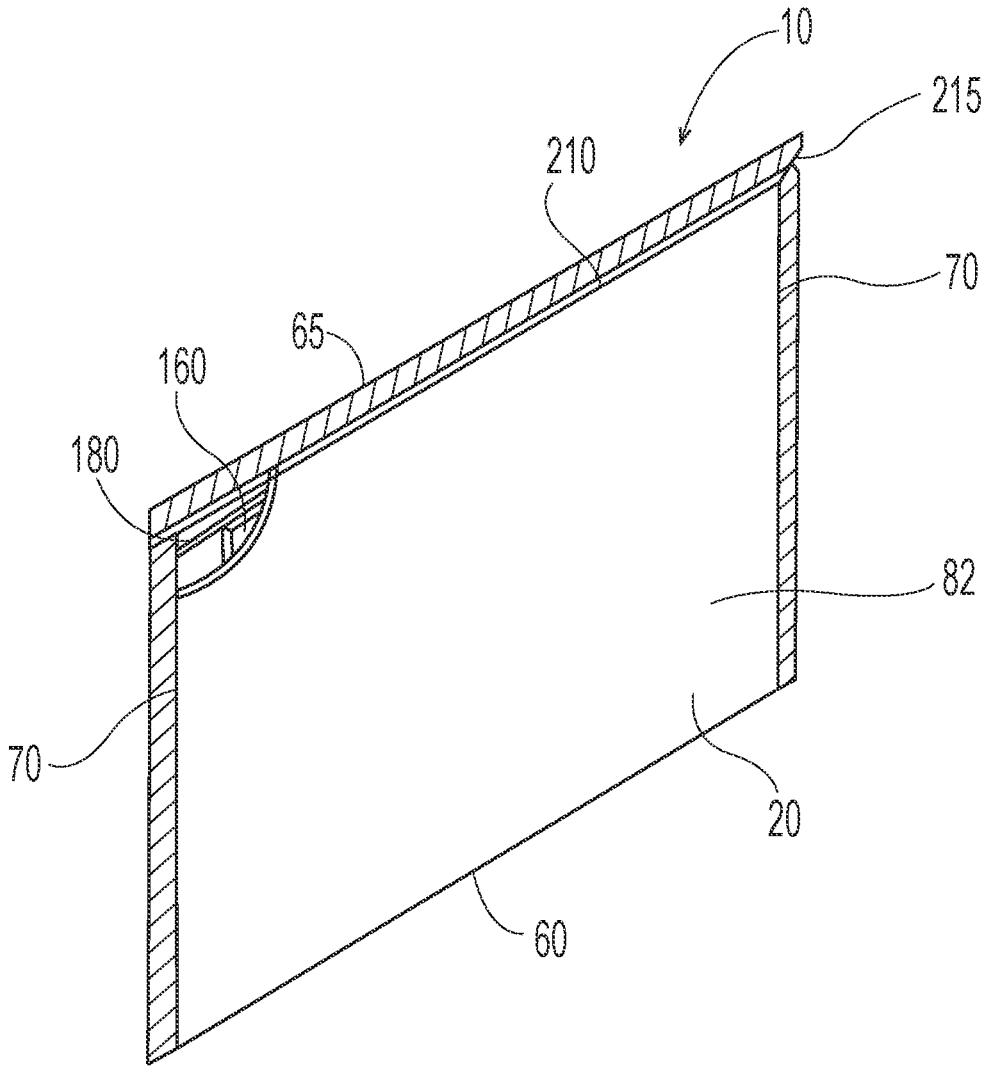
FIG. 5 is a perspective view of a bag having a removable tear strip.

The bag 10 can have a removable tear strip 210 to provide a structure to protect the closure 40 from opening unintentionally after the bag 10 is sealed in the packaging facility until the user desires to access the articles 2 (FIG. 5). The removeable tear strip 210 can be a predetermined line of weakness proximal the top of the bag. The removable tear strip 210 can join the first side panel 20 to the second side panel 30. The line of weakness can be a series of through perforations, through slits, partial perforations, scores, or other structural weakening of one or both of the first side panel 20 and second side panel 30. The line of weakness can be an intermittent cut and formed by a laser. The removable tear strip 210 can have an initiation end 215 to concentrate and direct the tearing force applied by the user towards the removable tear strip 210.

The first side panel 20 and second side panel 30 can be joined to one another at the first side panel transverse edges 70 and the second side panel transverse edges 100, top 65, and or bottom 60 by a heat seal, glue, adhesive, stitching, or the like. Optionally, the first side panel 20 and second side panel 30 can be continuous with one another as described herein across any one of the first side panel transverse edges 70 and second side panel transverse edges 100, top 65, or bottom 60. One or both of the first side panel interior facing surface 80 and the second side panel interior facing surface 90 can be coated with a composition that is heat sealable.

Figure 6:
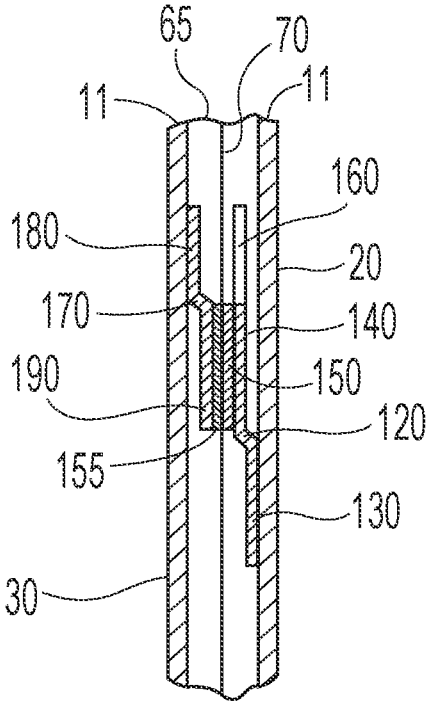
FIG. 6 is a cross section of part of a bag in which the adhesive is on a backing layer joined to the second interior part.

The repositionable pressure sensitive adhesive 150 can be carried on a backing layer 155 (FIG. 6). The backing layer 155 can be joined to the second interior part 190 or first exterior part 140. The backing layer 155 can be joined to the second interior part 190 or first exterior part 140 by a heat seal, glue, adhesive, stitching, or the like. The bond joining the backing layer 155 thereto can be stronger with respect to shear, normal, and peeling forces than the repositionable pressure sensitive adhesive 150 per se so that the backing layer 155 does not separate from the part to which the backing layer is joined when the bag 10 and contents therein are inverted.

The first interior part 130 of the first flexible angle 120 can be joined to the first side panel 20 by a heat seal, glue, adhesive, stitching, or the like. Likewise, the second exterior part 180 of the second flexible angle 170 can be joined to the second side panel 30 by a heat seal, glue, adhesive, stitching, or the like.

The bag 10 can be more than about 80%, optionally more than about 90%, optionally more than about 95% by weight paper. The greater the weight fraction of paper, the more easily the bag 10 can be recycled.

The bag 10 can be a quad-sealed bag, gusset bag, back sealed bag, 3-sided sealed bag, K-seal stand up bag, round-seal stand up bag, or normal-seal stand up bag.

Figure 7:
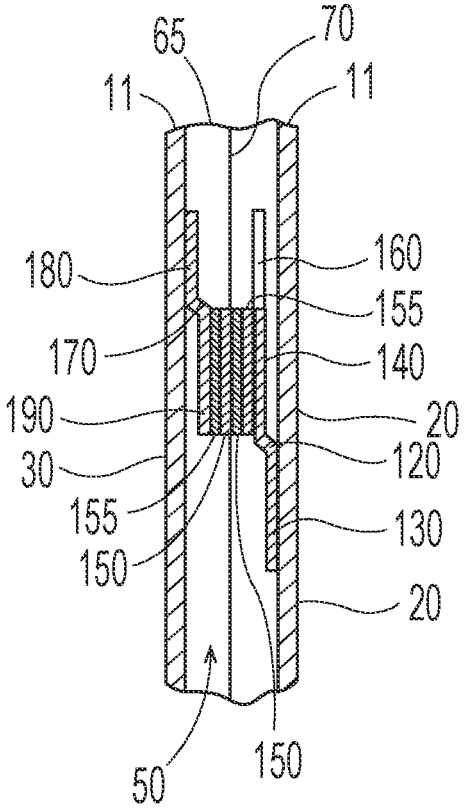
FIG. 7 is a cross section of part of a bag in which some of the adhesive is on a backing layer joined to the second interior part and some of the adhesive is on a backing layer joined to the first exterior part.

The repositionable pressure sensitive adhesive 150 can be provided on both the second interior part 190 and the first exterior part 140. For example a portion of the repositionable pressure sensitive adhesive 150 can be carried on a backing layer 155 joined to the second interior part 190 and another portion of the repositionable pressure sensitive adhesive 150 carried on a backing layer 155 joined to the first exterior part 140, by way of nonlimiting example as shown in FIG. 7. In this arrangement, the bag 10 can be opened by pulling the first exterior part 140 away, with one hand, from the second interior part 190, with the other hand, and some of the adhesive 150 remains on the backing layer 155 joined to the first exterior part 140 and some of the adhesive 150 remains on the backing layer 155 joined to the second interior part 190. This arrangement can provide for mechanical behavior similar to when the adhesive sides of two lengths of adhesive tape are contacted face to face with one another along their length and then peeled away from one another, with the similarity being for wide widths of tape peeled in that manner.

The bag 10 can be opened by a method comprising multiple steps. The second side panel 30 can be grasped at the top edge 11 of the second side panel 30 with one hand, wherein the top edge 11 is opposite the bottom 60 and outside the interior volume 50. The free flange 160 can also be grasped with another hand. The free flange 160 and second side panel 30 can be peeled away from one another to separate the first exterior part 140 and the second interior part 190 along the repositionable pressure sensitive adhesive 150 to open the bag 10. Optionally, the first exterior part 140 and the second interior part 190 can be reengaged with one another along the repositionable pressure sensitive adhesive 150 to close the bag 10.

Optionally the method of opening the bag 10 can comprise multiple steps. The second side panel 30 can be grasped at the top edge 11 of the second side panel 30 with one hand. The free flange 160 can also be grasped with another hand. The free flange 160 and the second side panel 30 can be peeled away from one another along the repositionable pressure sensitive adhesive 150 to open the bag 10. Optionally, the method can comprise the step of reengaging the first exterior part 140 and the second side panel 30 with one another along the repositionable pressure sensitive adhesive 150 to close the bag 10.

Substrates

Paper is a web of cellulose fibers, optionally comprising a minority of additional constituents. To provide for recyclability of the bag 10, the bag 10 can be predominantly constructed from substrates that are paper based. A paper based substrate has more than 80% by weight cellulose fibers. The paper based substrates may have various coatings, varnishes, ink, and the like that are typical for paper based packages and such materials are considered part of a paper based substrate. The web of cellulose fibers constituting the paper based substrate may also contain a minority of other additives and fillers for technical benefits, such materials are also being considered part of the paper base. The first side panel 20 and the second side panel 30 can be more than about 80% by weight paper, optionally more than about 90% by weight paper, optionally more than about 95% by weight paper. The weight of each of the first side panel 20 and the second side panel 30 is inclusive of coatings, varnishes, ink, additives, and fillers.

The first side panel 20 and second side panel 30 can be paper based. One or both of the first side panel interior facing surface 80 and the second side panel interior facing surface 90 can be coated or locally coated only where necessary with a thermoplastic material to facilitate joining the first side panel 20 and the second side panel 30. A coating on the first side panel interior facing surface 80 can also facilitate joining the first flexible angle 120 to the first side panel 20. A coating on the second side panel interior facing surface 90 can also facilitate joining the second flexible angle 170 to the second side panel 30. The bag 10 can be formed by folding the paper based substrate across the bottom 60 of the bag 10 and the first side panel 20 and second side panel 30 can be heat sealed to one another to form a heat seal at the junction of a first side panel transverse edge 70 and a second side panel transverse edge 100.

Further, the first side panel interior facing surface 80 and second side panel interior facing surface 90 can be coated with a polymeric material to resist oxygen, water, and or water vapor transmission through the respective panel. Likewise, the exterior facing surfaces of the first side panel 20 and second side panel 30 can comprise a coating, varnish, or ink, to provide for the desired overall aesthetic, quality printing, and or technical performance of bag 10.

The first side panel interior facing surface 80 and second side panel interior facing surface 90 can be coated with a thin layer of polymeric coating. The coating can be selected from, by way of nonlimiting example, low density polyethylene, linear low density polyethylene, high density polyethylene, polypropylene, polyacrylamide, linear polyacrylamide, styrene butadiene copolymer, and combinations thereof. The coating can be a slot coated, spray coated, extrusion coated, dispersed, or printed onto the skeleton of the paper based substrate. Optionally, the coating can be applied as a powder that is heated and or compressed to form the coating. A coating on the first side panel interior facing surface 80 and or second panel interior facing surface 90 can facilitate heat sealing, acoustic sealing, or hot melt sealing of the of the first side panel interior facing surface 80 to the second side panel interior facing surface 90 along a first side panel transverse edge 70 and a second side panel transverse edge 100. The interior facing surfaces can be coated in locations at which and near to where heat sealing is employed to join the elements of the bag 10. That is portions of the interior facing surfaces may be uncoated. Optionally, portions of the interior facing surfaces can be uncoated so that that paper is exposed to the contents of the bag 10. The paper can help draw away moisture from the contents or air space within the bag 10. This might be practical if the contents are soluble unit dose laundry products since excess moisture may form pinholes in the products or may cause the products to stick to one another. The interior facing surfaces can be uncoated, which might be practical if glue or other adhesive is employed to join the elements of the bag 10. Optionally, the exterior facing surfaces may be coated with a thin layer of polymeric coating to limit or prevent ingress of moisture into the bag 10. Optionally, the first side panel 20 and second side panel 30 can be a paper laminate in which an interior layer is a layer of polymeric material, which can limit or prevent ingress of moisture into the bag 10 and leave a paper material exposed to the interior volume 50 of the bag 10. The paper based substrates forming the first side panel 20 and second side panel 30, and optionally the flexible angles subsequently described herein, can have a basis weight, inclusive of the coatings, varnishes, ink, additives, and fillers, from about 20 to about 500 g/m$^2$, optionally from about 20 to about 300 g/m$^2$, optionally from about 30 to about 150 g/m$^2$. The first side panel exterior facing surface 82 and the second side panel exterior facing surface 92 can be non-continuously coated or uncoated. Less than about 10%, optionally less than about 5%, by area of the first side panel exterior facing surface 82 and the second side panel exterior facing surface 92 can be coated. To improve recyclability, it can be beneficial that at least one surface of the each of the panels be non-continuously coated, uncoated, or only have a small areal portion coated so that the paper constituting such panel can be easily separated from any coating employed. Moreover, uncoated, non-continuously coated, or substantially uncoated (e.g. less than about 10% of the first side panel exterior facing surface 82 and the second side panel exterior facing surface 92, or lesser percentage as described above) exterior facing surfaces 82 can make it apparent to the user of the bag 10 that the bag 10 is intended to be recycled in the paper recycling stream. The paper based substrates for the side panels and flexible angles can be, by way of nonlimiting example, MONDI AEGIS 84 grams per square meter white or MONDI AEGIS 136 grams per square meter brown, available from Mondi, PLC, Addlestone, Surrey, United Kingdom.

Figure 8:
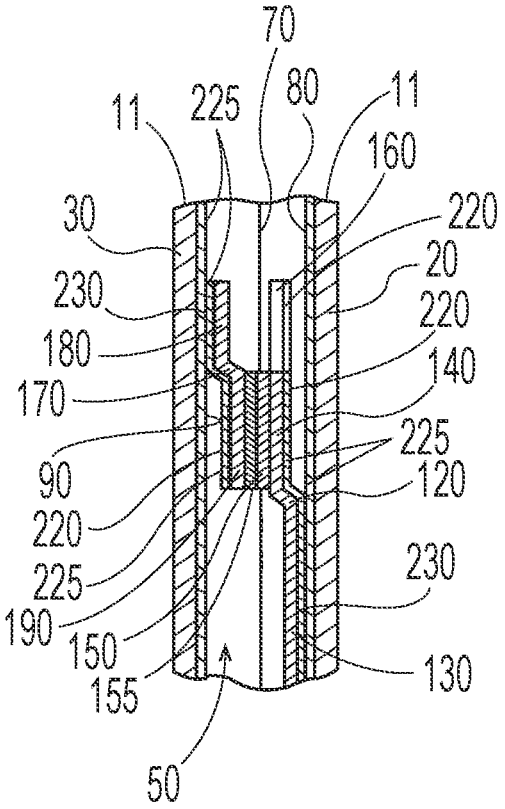
FIG. 8 is a cross section of part of a bag.

The first flexible angle 120 and second flexible angle 170 can also be paper based substrates and also incorporate coatings, varnishes, ink, additives, and fillers. The coating can be a polymeric coatings 225 or partial polymeric coatings 225 as described above with respect to the first side panel 20 and second side panel 30 for the same benefits (FIG. 8). The first flexible angle 120 and the second flexible angle 170 can each have an outward facing surface 220. The outward facing surfaces 220 can be oriented away from one another. The first side panel interior facing surface 80, second side panel interior facing surface 90, and at least a portion of each outward facing surface 220 can be coated or partially coated with a polymeric coating 225. The outward facing surface 220 of the first flexible angle 120 can be joined to the first side panel interior facing surface 80 by a heat seal 230 of the polymeric coating 225. The outward facing surface 220 of the second flexible angle 170 can be joined to the second side panel interior facing surface 90 by a heat seal 230 of the polymeric coating 225. The polymeric coating 225 can have a thickness from about 2 μm to about 50 μm, optionally from about 4 μm to about 30 μm, optionally from about 6 μm to about 20 μm. The polymeric coating 225 can be polyethylene.

Each of the first flexible angle 120, inclusive of the free flange 160, and the second flexible angle 170 can be more than about 80% by weight paper, optionally more than about 90% by weight paper, optionally more than about 95% by weight paper. The weight of each of the first flexible angle 120, inclusive of the free flange 160, and the second flexible angle 170 is inclusive of coatings, varnishes, ink, additives, and fillers, if present in or on the respective flexible angle.

Optionally, the first flexible angle 120 and or the second flexible angle 170 can be a polymeric film. If these components are a polymeric film, it can be desirable that these components constitute less than about 20% by weight, or even less than about 15% by weight, or even less than about 10% by weight of the bag 10 so that the bag 10 can be recyclable in a typical recycling stream. The first flexible angle 120 can be joined to the first side panel 20 by a heat seal, glue, adhesive, stitching, or the like. The second flexible angle 170 can joined to the second side panel 30 by a heat seal, glue, adhesive, stitching, or the like.

The portion of any substrate from which the repositionable pressure sensitive adhesive 150 is released may be surface treated or include a release layer so that the repositionable pressure sensitive adhesive 150 releases cleanly therefrom. For example, the surface may be treated with a silicone release coating or wax. Optionally, the release layer can be a thin layer of low density polyethylene, linear low density polyethylene, high density polyethylene, polypropylene, polyacrylamide, linear polyacrylamide, or similar thermoplastic polymer.

Repositionable Pressure Sensitive Adhesive and Backing Layer

The repositionable pressure sensitive adhesive 150 provides for the ability to reseal the bag 10 after opening the closure 40. A repositionable pressure sensitive adhesive 150 is an adhesive that bonds to a substrate by the application of pressure. The pressure sensitive adhesive 150 can have an average peak tack force measured according ASTM D6195-03 (Reapproved 2019) Test Method A (Using a Tensile Tester) that diminishes by less than 80%, optionally less than 60%, optionally less than 50%, optionally less than 20%, after 80 opening and closing cycles of the pressure sensitive adhesive 150 against the surface to which the pressure sensitive adhesive 150 is engaged in the bag 10. A peak tack force that degrades to some degree as a function of cycles may not overly impair function of closure since some of the contents of the bag 10 are likely to be removed from the bag 10 each time the user opens and closes the bag 10 which tends to lessen the strength of the closure 40 needed to make it likely that the bag 10 can remain closed when the bag 10 is inverted. A repositionable pressure sensitive adhesive 150 can be repositionable from about 10 to about 200 times. The repositionable pressure sensitive adhesive 150 can be repositionable for from about 1 to about 24 months. The bonding strength may be influenced by the amount of pressure applied and characteristics of the substrate such as smoothness and surface energy. Repositionable pressure sensitive adhesive 150 tends to exhibit viscoelastic behavior. A repositionable pressure sensitive adhesive 150 forms a bond to a substrate by way of the repositionable pressure sensitive adhesive flowing to wet the substrate with the repositionable pressure sensitive adhesive 150. The integrity of the bond is maintained by the cohesive strength of the repositionable pressure sensitive adhesive 150 and the molecular interactions between the repositionable pressure sensitive adhesive 150 and substrate. The repositionable pressure sensitive adhesive 150 can form viscoelastic bonds that are permanently tacky and adhere when pressure is manually applied and no activation, for example water, solvent, or heat, is required.

The repositionable pressure sensitive adhesive 150 can comprise various compositions and can be comprised of elastomeric polymers with or without tackifiers. The repositionable pressure sensitive adhesive 150 can be selected from acrylic and methacrylic ester homo or copolymers, butyl rubber based systems, silicones, nitriles, styrene block copolymers, ethylene vinyl acetate, urethanes, vinyl esters and amides, olefin copolymer materials, natural or synthetic rubber, and the mixtures thereof. The repositionable pressure sensitive adhesive 150 can be selected from rubber adhesive, acrylic adhesive, modified acrylic adhesive, silicone adhesive, and combinations thereof. Rubber or rubber-based repositionable pressure sensitive adhesives 150 may not perform as well as other repositionable pressure sensitive adhesives 150.

The repositionable pressure sensitive adhesive 150 is a removable repositionable pressure sensitive adhesive 150 in that the repositionable pressure sensitive adhesive 150 can be separated from the substrate without damage to the repositionable pressure sensitive adhesive 150 per se or the substrate. The repositionable pressure sensitive adhesive 150 can provide for unsealing and resealing of the closure 40 from about 10 to 200 times. The repositionable pressure sensitive adhesive 150 can be AR101, SR106, R1490M, SR692N, available from AVERY DENNISON, Glendale, California, United States of America.

The repositionable pressure sensitive adhesive 150 can be applied directly to the substrate or can be carried on a backing layer 155 that is joined to the substrate so that the backing layer 155 is between the repositionable pressure sensitive adhesive 150 and the substrate. The backing layer can be paper, film, or foil. Suitable backing layers 155 include polymers, including, but not limited to, polyethylene terephthalate, polyethylene, polypropylene, copolymers such as polyethylene-propylene, polyethylene-octene, olefinic block copolymer and polystyrene films. The backing layer 155 can be selected from polyester, polypropylene, polyethylene, polyethylene/polypropylene co-polymer, UHMS-PE, polyvinyl chloride, polyimide, polyamide, polytetrafluoroethylene, polyvinyl alcohol, polyurethane, polyvinyl fluoride, and combinations thereof. The backing layer 155 can be selected from crepe paper, flatback paper, kraft paper, machine glazed uncoated kraft paper, machine finished uncoated kraft paper, parchment, super calendered kraft paper, clay-coated kraft paper, poly-coated kraft paper, glassine paper, and combinations thereof. The backing layer 155 can be selected from cotton cloth, glass cloth, vinyl cloth, and combinations thereof. The backing layer 155 can be fibrous. The backing layer 155 can be aluminum, copper, lead, stainless steel, and combinations thereof. The backing layer 155 can be neoprene. The backing layer 155 can have a basis weight from about 50 g/m$^2$ to about 400 g/m$^2$, optionally from about 80 g/m$^2$ to about 300 g/m$^2$, optionally from about 100 g/m$^2$ to about 200 g/m$^2$. A paper based backing layer 155 may be beneficial to improve the recyclability of the bag 10.

The backing layer 155 can be joined to the substrate by a heat seal, glue, adhesive, stitching, or the like. The repositionable pressure sensitive adhesive 150 can be a continuous coating on one side of the backing layer 155. Optionally, the repositionable pressure sensitive adhesive 150 can coat less than the entirety of one side of the backing layer 155. The repositionable pressure sensitive adhesive 150 can be a discontinuous coating, for example islands of repositionable pressure sensitive adhesive 150, on one side of the backing layer 155. The repositionable pressure sensitive adhesive 150 can have a thickness from about 5 microns to about 500 microns.

The repositionable pressure sensitive adhesive 150 can be on a surface selected from first exterior part 20, second side panel interior facing surface 90, and combinations thereof.

The repositionable pressure sensitive adhesive 150 can be a water based acrylic repositionable pressure sensitive adhesive. The repositionable pressure sensitive adhesive 150 can be a water based styrene butadiene copolymer latex. The repositionable pressure sensitive adhesive 150 can be a rubber based repositionable pressure sensitive adhesive in a solvent solution. The repositionable pressure sensitive adhesive 150 can be a polyurethane elastomer based adhesive. The repositionable pressure sensitive adhesive 150 can be IVY GRIP TAPE, available from HONGXIN-SHOP on www.amazon.com as of Mar. 26, 2021. The repositionable pressure sensitive adhesive 150 can be a hotmelt adhesive. Hotmelt repositionable pressure sensitive adhesive 150 may provide more flexibility in the formulation chemistry of such hotmelt.

The repositionable pressure sensitive adhesive 150 can be, by way of nonlimiting example, TACKWHITE NA 55, TACKWHITE AMC 20, TACKWHITE AMC 3 D, TACKWHITE AMC 24, TACKWHITE AMC 4 D, TACKWHITE AP 5M, TACKWHITE SB4 B2, TACKWHITE SB5 SL5, SOLACRIL SPR 12 M3, SOLACRIL WS 33, SOLACRIL 44, SOLACRIL WS 60, SOLACRIL WS 40 N, SOLACRIL 206, SOLACRIL 306, SOLACRIL 203, SOLACRIL 303, or TACKMELT R 008, available from ICHEMCO, Milan, Italy. The repositionable pressure sensitive adhesive can be ROBOND PS-9260, ROBOND, PS-8120HV, or ROBOND PS-8942, available from Dow, Inc., Midland, Michigan, United States of America. The repositionable pressure sensitive adhesive can be styrene-isoprene-styrene copolymer (SIS). The repositionable pressure sensitive adhesive 150 can be SAVARE PL501ZK, available from SAVARE I.C. srl, Milano, Italy. The repositionable pressure sensitive adhesive 150 can be a mixture of ethylene-vinyl acetate and styrene block copolymer, for example a fashion tape such as FASHION TAPE sold by www.hollywoodfashionsecrets.com. The repositionable pressure sensitive adhesive 150 can have a load at failure according to ASTM D3165-07(2014) from about 0.05 to about 0.5 MPa. The repositionable pressure sensitive adhesive 150 can have an average T-peel strength according to ASTM D903-98(2017) from about 0.01 to about 0.5 N/mm.

Figure 9:
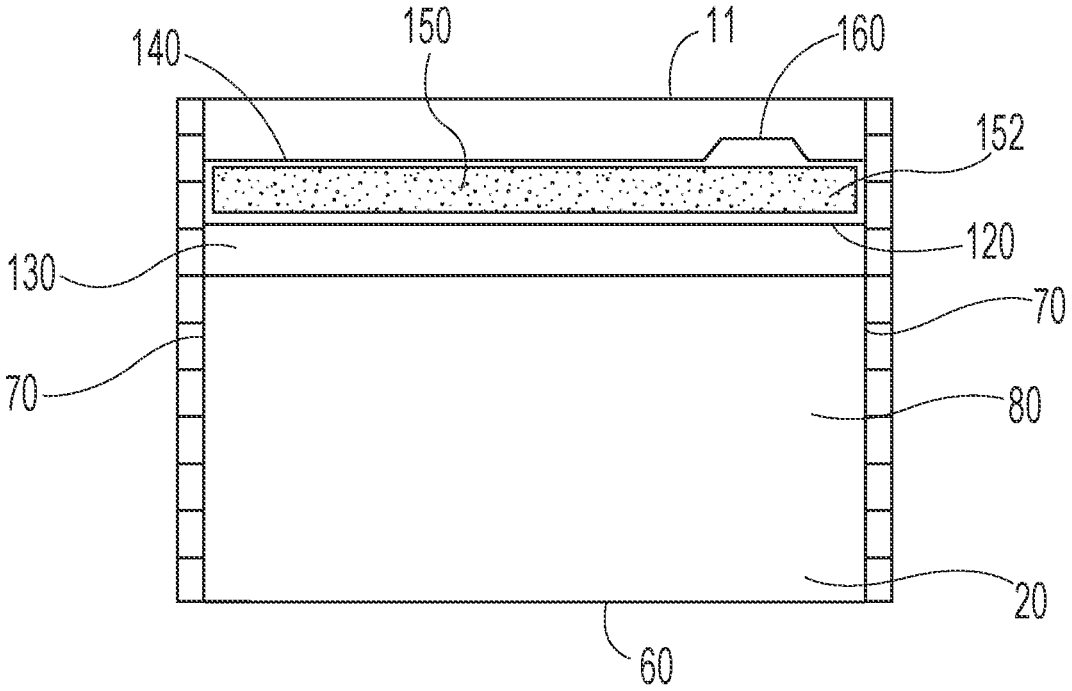
FIG. 9 is a side view of the first side panel with the first side panel interior facing surface oriented towards the viewer and illustrating the first flexible flange, release zone, and repositionable pressure sensitive adhesive.

The first exterior part 140 can be releasably engaged with the second interior part 190 by the repositionable pressure sensitive adhesive 150 over a release zone 152 (FIG. 9). The release zone 152 can have a release area from about 100 mm$^2$ to about 21000 mm$^2$. The release area is a scalar quantity measurement of the area of the release zone 152. The release zone 152 is the locus at which the first exterior part 140 and second interior part 190 are releasably engaged. The repositionable pressure sensitive adhesive 150 is the material through which the first exterior part 140 and the second interior part 190 are releasably engaged with one another. The release zone 152 may be a continuous area, such as a continuous slot coated area, and may have islands of unengaged portions of the first exterior part 140 and the second interior part 190 which are not part of the release zone and do not count towards the area of the release zone. The release zone 152 may be a discontinuous area, such as islands of repositionable pressure sensitive adhesive, stripes, annuluses, and the like.

The closure length, which is a measure of the length along the longitudinal axis L of the part of the closure 40 that is intended to be opened and re-closed, can be from about 100 mm to about 420 mm. The closure height, which is a measure of the height of the part of the closure 40 that is intended to be opened and re-closed, that is the repositionable pressure sensitive adhesive 150, and is measured orthogonal to the longitudinal axis L can be from about 1 mm to about 50 mm, optionally from about 5 mm to about 50 mm, optionally from about 5 mm to about 30 mm, optionally from about 10 mm to about 25 mm. Closure heights below 1 mm, or even 5 mm, may be challenging for the user reclose properly since the user may have to carefully attend to identifying and locating the repositionable pressure sensitive adhesive 150 and competently engaging the repositionable pressure sensitive adhesive 150 with the surface to which it is intended to engage. Closures heights greater than 50 mm may be unwieldy for the user to work with. A closure height greater than 50 mm may fold or wrinkle uncontrollably when the closure 40 is open and adjacent portions of the repositionable pressure sensitive adhesive 150 may become engaged with one another, making the closure 40 difficult to properly reclose. Further, large closures may increase non paper based fraction of the bag 10 since a greater amount of repositionable pressure sensitive adhesive 150 may be used. Opening and reclosing the closure 40 multiple times may contaminate the pressure sensitive adhesive 150 or the surface to which it engages. The contamination source may be, by way of nonlimiting example, dust from the air, dust from the contents of the bag 10, oil or other substance transferred from the user's fingers, water, or other substance to which the closure 40 is exposed when the closure 40 is open. The greater the closure height, the less sensitive the closure 40 might be to contamination. A closure height less than 1 mm may be more sensitive to contamination than desired.

The bag 10 can contain from about 10 g to about 5000 g of articles 2. The bag 10 can contain from about 100 g to about 2500 g of articles 2. The bag 10 can contain from about 400 g to about 1800 g of articles 2. The ratio of the release area to the mass of articles 2 contained in the bag 10 can be from about 80 $mm^2$ per 100 g to about 1250 $mm^2$ per 100 g, optionally from about 250 $mm^2$ per 100 g to about 1000 $mm^2$ per 100 g, optionally from about 300 $mm^2$ per 100 g to about 800 $mm^2$ per 100 g.

For a bag 10 including a first flexible angle 120 and a second flexible angle 170, as described herein, and containing articles 2, in consistent units, the product of the load at failure according to ASTM D3165-07(2014) of the repositionable pressure sensitive adhesive 150 and the release area can be from about 2 to about 500, optionally from about 20 to about 300, optionally from about 50 to about 200, optionally from about 80 to 180 times greater than the cumulative weight of articles 2 contained in the bag 10. The load at failure according to ASTM D3165-07(2014) is reported in megapascals. Converting the load at failure according to ASTM D3165-07(2014) can be avoided in the aforesaid relationship by providing the release area in square meters and the force induced by the weight of articles 2 in the bag 10 in meganewtons. Without being bound by theory it is thought that by providing the product of the load at failure according to ASTM D3165-07(2014) of the repositionable pressure sensitive adhesive 150 and the release area in the range of from about 2 to about 500 times, optionally from about 5 to about 300 times, optionally from about 5 to about 100 times, optionally from about 2 to about 50 times, optionally from about 2 to about 20 times, greater than the weight of articles 2 contained in the bag 10 sufficiently limits the likelihood of viscoelastic failure of the adhesive 150 under the expected use over the expected life-cycle of the bag 10 and articles 2 contained therein.

Example 1 of a bag 10 was constructed as follows. The bag 10 had a length along the longitudinal axis L of 320 mm. The bag 10 had a height of 300 mm measured orthogonal to the longitudinal axis. The first side panel 20 and second side panel 30 were 130 $g/m^2$ paper. The first side panel interior facing surface 80 and second side panel interior facing surface 90 had a 6 μm polyethylene coating. The first flexible angle 120 was constructed 2 layers of 3M SCOTCH 244 yellow masking paper tape 50 mm wide and assembled congruently with the adhesive sides facing one another. The second flexible angle 170 was constructed of 2 layers of 3M SCOTCH 244 yellow masking paper tape cut to be 40 mm wide and assembled congruently with the adhesive sides facing one another. The first flexible angle 120 and the second flexible angle 170 were attached to the respective side panel by a double sided tape, TESA FIX 4970 12 mm. FASHION TAPE 12.5 mm wide, available from HOLLYWOOD FASHION SECRETS, was used as the repositionable pressure sensitive adhesive 150 and was adhered to exposed adhesive of the 3M SCOTCH 244 yellow masking paper tape forming the first exterior part 140 of the first flexible angle 170 and then engaged with the second interior part 190. The bag 10 was constructed in a conditioned room at 23 C and 50% relative humidity. A FINAT 2 kg roller was used to engage the tapes and repositionable pressure sensitive adhesive 150 of Example 1. The first side panel 20 and second side panel 30 were not joined at the bottom 60 of the bag. The structure of Example 1 is in general like that shown in FIG. 4.

Example 2 of a bag 10 was constructed as follows. The bag 10 had a length along the longitudinal axis L of 320 mm. The bag 10 had a height of 300 mm measured orthogonal to the longitudinal axis. The first side panel 20 and second side panel 30 were 130 $g/m^2$ paper. The first side panel interior facing surface 80 and second side panel interior facing surface 90 had a 6 μm polyethylene coating. The first flexible angle 120 was constructed of 2 layers of 3M SCOTCH 244 yellow masking paper tape 50 mm wide and assembled congruently with the adhesive sides facing one another. The second flexible angle 170 was constructed of 2 layers of 3M SCOTCH 244 yellow masking paper tape cut to be 40 mm wide and assembled congruently with the adhesive sides facing one another. Unlike Example 1 above, for the first flexible angle 120, the first exterior part 140 and the first interior part 130 were together attached to the first side panel 20 by 25 mm wide double sided tape, TESA FIX 4970. Likewise, and unlike Example 1 above, for the second flexible angle 170 the second interior part 190 and second exterior part 180 were together attached to the second side panel 30 by 25 mm wide double sided tape, TESA FIX 4970. FASHION TAPE 12.5 mm wide, available from HOLLY- WOOD FASHION SECRETS, was used as the repositionable pressure sensitive adhesive 150 and was adhered to exposed adhesive of the 3M SCOTCH 244 yellow masking paper tape forming the first exterior part 140 of the first flexible angle 170 and then engaged with the second interior part 190. Example 2 exemplifies a closure in which the first flexible angle 120 and second flexible angle 170 are adhered to the first side panel 20 and second side panel 30, respectively. The bag 10 was constructed in a conditioned room at 23 C and 50% relative humidity. A FINAT 2 kg roller was used to engage the tapes and repositionable pressure sensitive adhesive 150 of Example 1. The first side panel 20 and second side panel 30 were not joined at the bottom 60 of the bag.

The bags of Example 1 and 2 were inverted and filled with approximately 1700 g of ARIEL 3-in-1 laundry pods (soluble unit dose detergent products).

Static loading tests were conducted on Examples 1 and 2 by hanging each bag containing its contents upside down so that the closure 40 was loaded. The bags 10 were hung by a sling of 50 mm wide PET tape extending from the center of top edges 11 to 150 mm beyond vertical extent of each side panel. The length of time for the closure 40 of each bag 10 to open under the load of the contents of the bag 10 was recorded.

A dynamic loading test was also conducted by clamping the filled and inverted bag 10 being tested to a 250 N load cell. The bag 10 was lifted 15 cm and dropped. The filled bag 10 free fell a distance of 15 cm until caught by the sling. The impact energy from the free falling bag 10 was recorded by the load cell as the peak force in newtons.

Results of the static load test and dynamic load test on Examples 1 and 2 are in Table 1 below. Example 1 is a bag having a general construction like that shown in FIG. 4 in that a first flexible angle 120 and second flexible angle 170 are provided and the first exterior part 140 and second interior part 190 can counter rotate relative to the first interior part 130 and the second exterior part 180, respectively. Example 2 is a bag 10 in which the first exterior part 140 is adhered to the first side panel 20 and the second interior part 190 is adhered to the second side panel 30. In Example 2, the flexible angles are unable to counter rotate in a manner like that shown in FIG. 4, thereby predominantly applying a peeling load to the closure 40.

TABLE 1

Static loading test and dynamic loading test on Examples 1 and 2.

| Configuration | Product load ± 15 g (g) | Static Loading Test: Time to Open | Dynamic Loading Test (# of drops until closure opened) | Dynamic Loading Test Peak Load Recorded (N). |
|---|---|---|---|---|
| Example 1 | 1700 | 46 hours | The closure remained closed for 60 drops after which the test was ended | 50-60 |
| Example 2 | 1700 | <1 minute | 1 drop resulted in the closure opening | Peak load not applicable since failure occurred on first drop |

Based on the results of the tests shown in Table 1, providing a bag 10 having a first flexible angle 120 and second flexible angle 170 in which the first exterior part 140 and second interior part 190 can counter rotate relative to the first interior part 130 and the second exterior part 180, respectively, can perform better under a static loading test and a dynamic loading test than a bag 10 in which the first exterior part 140 and the second exterior part 190 are adhered to first side panel 20 and second side panel 30, respectively. The bag 10 of Example 2 is expected to represent the performance of a simple construction of a bag 10 in which the closure 40 is just the repositionable pressure sensitive adhesive 150 engaging the first side panel 20 and the second side panel 30. In such a bag 10, when closed and inverted, the repositionable pressure sensitive adhesive 150 is expected to be loaded predominantly by peeling forces. In the bag 10 of Example 1, the repositionable pressure sensitive adhesive 150 may tend to be predominantly loaded in shear.

Example 3 is a modification of Example 1. Example 3 differs from Example 1 in that the first flexible angle 120 was constructed of 2 layers of 3M SCOTCH 3434 blue masking paper tape 50 mm wide and assembled congruently with the adhesive sides facing one another. The repositionable pressure sensitive adhesive 150 was a 25.4 mm wide portion of exposed 3M SCOTCH 3434 blue masking tape which was then engaged with the second interior part 190.

Example 4 is modification of Example 3. Example 4 differs from Example 3 in that for the first flexible angle 120, the first exterior part 140 and the first interior part 130 were together attached to the first side panel 20 by 25 mm wide double sided tape, TESA FIX 4970. Likewise, and unlike Example 3 above, for the second flexible angle 170, the second interior part 190 and second exterior part 180 were together attached to the second side panel 30 by 25 mm wide double sided tape, TESA FIX 4970.

Examples 3 and 4 were constructed so that the repositionable pressure sensitive adhesive 150 in Examples 3 and 4 was the repositionable pressure sensitive adhesive 150 of 3M SCOTCH 3434 in contrast to the FASHION TAPE 12.5 mm wide, available from HOLLYWOOD FASHION SECRETS, used in Examples 1 and 2.

Results of the static load test and dynamic load test on Examples 3 and 4 are in Table 2 below. Example 3 is a bag having a general construction like that shown in FIG. 4 in that a first flexible angle 120 and second flexible angle 170 are provided and the first exterior part 140 and second interior part 190 can counter rotate relative to the first interior part 130 and the second exterior part 180, respectively. Example 4 is a bag 10 in which the first exterior part 140 is adhered to the first side panel 20 and the second interior part 190 is adhered to the second side panel 30. In Example 4, the flexible angles are unable to counter rotate in a manner like that shown in FIG. 4, thereby predominantly applying a peeling load to the closure 40.

TABLE 2

Static loading test and dynamic loading test on Examples 3 and 4.

| Configuration | Product load ± 15 g (g) | Static Loading Test: Time to Open | Dynamic Loading Test (# of drops until closure opened) | Dynamic Loading Test Peak Load Recorded (N). |
|---|---|---|---|---|
| Example 3 | 3700 for Static Loading Test. 1700 for Dynamic Loading Test. | Closure remained closed for 6 weeks after which the test was ended. | The closure remained closed for 500 drops after which the test was ended | 50-60 |
| Example 4 | 3700 for Static Loading Test. 1700 for Dynamic Loading Test. | 22 hours | 79 | 50-60 |

Based on the results of the tests shown in Table 1, providing a bag 10 having a first flexible angle 120 and second flexible angle 170 in which the first exterior part 140 and second interior part 190 can counter rotate relative to the first interior part 130 and the second exterior part 180, respectively, can perform better under a static loading test and a dynamic loading test than a bag 10 in which the first exterior part 140 and the second exterior part 190 are adhered to first side panel 20 and second side panel 30, respectively. The bag 10 of Example 4 is expected to represent the performance of a simple construction of a bag 10 in which the closure 40 is just the repositionable pressure sensitive adhesive 150 engaging the first side panel 20 and the second side panel 30. In such a bag 10, when closed and inverted, the repositionable pressure sensitive adhesive 150 is expected to be loaded predominantly by peeling forces. In the bag 10 of Example 3, the repositionable pressure sensitive adhesive 150 may tend to be loaded in shear. The repositionable pressure sensitive adhesive 150 employed in Example 3 performed comparatively better than the repositionable pressure sensitive adhesive 150 employed in Example 1 with respect to the static loading test time to open measure. The repositionable pressure sensitive adhesive 150 employed in Example 4 performed comparatively better than the repositionable pressure sensitive adhesive 150 employed in Example 2, with respect to the static loading test time to open measure and the dynamic loading test measure.

Contents of the Bag

The bag 10 can contain dry food product. The dry food product can be for animal consumption, including human consumption. The dry food product can be, by way of nonlimiting example, food pellets, grain products, ground grain products, hops, powder, chips, fruit, dried fruit, dried fungi, legumes, coffee, sugar, corn products, tea, salt, spices, and the like. The bag 10 can contain fibrous water soluble products, for example nonwoven webs of water soluble fibers that carry fabric care actives, oral care actives, hair care actives, or skin care or cleaning actives, hard surface care actives, and the like. The bag 10 can contain, by way of nonlimiting example, disposable absorbent articles, incontinence garments, bibs, diapers, sanitary napkins, panty liners, tampons, training pants, wipes, hand soaps, oral care implements, products for treating hair, products for treating skin, personal cleansing articles, orally administered products, fabric and laundry conditioning products, fabric or laundry care and or detergent products, dishwashing products, cleaning products, hard surface cleaning products, oral care products, lozenges, topical or oral pain relievers, nutritional supplements, vitamins, probiotic, nutritional fiber, nutritional minerals, pet food, razors, grooming implements, food products for human consumption, food products for domesticated animal consumption, food products for wild animal consumption, and the like.

The bag 10 can contain a liquid composition, a gel composition, a paste, a dispersion, a solid composition, or a plurality of articles 2. The liquid composition, gel composition, paste, dispersion, solid composition, or plurality of articles 2 can be, by way of nonlimiting example, a detergent composition, a laundry fabric softener, a laundry scent additive, a laundry care additive. The liquid composition, gel composition, paste, dispersion, solid composition, or plurality of articles 2 can be, by way of nonlimiting example, an automatic dishwashing detergent or a hard surface treatment composition. The solid composition can be, by way of nonlimiting example, blown powder, crystals, coated crystals, melt formed bodies, extruded particles, spheronized particles, molded particles, tablets, and the like. The solid composition can be a free flowing or compacted, by way of nonlimiting example.

The articles 2 can be water-soluble unit dose articles 2. The water-soluble unit dose articles 2 can be a water-soluble pouch containing a unitary dose of a composition as a volume sufficient to provide a benefit in an end application. The bag 10 can comprise from about 1 to about 100 water-soluble unit dose articles 2.

The water-soluble unit dose article 2 can comprise at least one water-soluble film shaped such that the unit-dose article comprises at least one internal compartment surrounded by the water-soluble film. The at least one compartment can comprise a detergent composition. The water-soluble film can be sealed such that the detergent composition does not leak out of the compartment during storage. Upon addition of the water-soluble unit dose article to water, the water-soluble film can dissolve and releases the contents of the internal compartment into the wash liquor. The detergent composition can be a liquid or solid.

The unit dose article 2 may comprise more than one compartment, even at least two compartments, or even at least three compartments, or even at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may even be orientated in a 'tire and rim' arrangement, i.e. a first compartment is positioned next to a second compartment, but the first compartment at least partially surrounds the second compartment, but does not completely enclose the second compartment. Alternatively, one compartment may be completely enclosed within another compartment.

Each individual unit dose article 2 may have a weight of between 10 g and 40 g, or even between 15 g and 35 g.

The water-soluble film of the unit dose article 2 can be soluble or dispersible in water. Prior to be being formed into a unit dose article 2, the water-soluble film can have a thickness of from 20 to 150 micron.

The film materials can be polymeric materials. The film material can, for example, be obtained by casting, blow-molding, extrusion or blown extrusion of the polymeric material. The water-soluble film can comprise polyvinyl alcohol homopolymer or polyvinyl alcohol copolymer, optionally a blend of polyvinylalcohol polymers and/or polyvinylalcohol copolymers, wherein the polyvinyl alcohol copolymers are optionally selected from sulphonated and carboxylated anionic polyvinylalcohol copolymers optionally carboxylated anionic polyvinylalcohol copolymers, optionally a blend of a polyvinylalcohol homopolymer and a carboxylated anionic polyvinylalcohol copolymer or blend of polyvinyl alcohol homopolymers. Optionally, the water-soluble film can comprise a polymer wherein the polymer can comprise a homopolymer, copolymer, or mixture thereof selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, xanthum, carragum or a mixture thereof, optionally, polyvinylalcohol homopolymers and/or anionic polyvinylalcohol copolymers optionally selected from sulphonated and carboxylated anionic polyvinylalcohol copolymers especially carboxylated anionic polyvinylalcohol copolymers. The films can be those supplied by Monosol, a Kuraray Division, Merrillville, Indiana, United States of America, under the trade references M8630, M8900, M8779, M8310. The film can be opaque, transparent or translucent. The film can comprise a printed area. The area of print may be achieved using standard techniques, such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. A suitable level includes, but is not limited to, 1 to 5000 ppm.

The water-soluble film or water-soluble unit dose article 2 or both may be coated with a lubricating agent. Optionally, the lubricating agent can be selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

Optionally, the detergent composition is a perfumed detergent composition. Perfumed detergent composition includes perfume added to the detergent composition. By unencapsulated perfume we herein mean perfume compounds are added directly to the detergent composition and are not present on encapsulates or on carrier materials. The composition might also comprise secondary perfume sources such as perfume capsule and/or pro-perfume e.g. perfume bound to a carrier material technology. The unencapsulated perfume can be formulated to be in a liquid laundry detergent composition to be provided in a water soluble unit dose article. The detergent composition can comprise between 0.01 and 10% of unencapsulated perfume. In addition to unencapsulated perfume, the detergent composition might also comprise encapsulated perfumes or pro-perfume technologies, or a mixture thereof.

The laundry detergent composition can comprise a non-soap surfactant, wherein the non-soap surfactant comprises an anionic non-soap surfactant and a non-ionic surfactant. Optionally, the laundry detergent composition can comprise between 10% and 60% by weight of the laundry detergent composition of the non-soap surfactant. The weight ratio of non-soap anionic surfactant to nonionic surfactant can be from 1:1 to 20:1. The non-soap anionic surfactant can comprise linear alkylbenzene sulphonate, alkyl sulphate or a mixture thereof. The weight ratio of linear alkylbenzene sulphonate to alkyl sulphate can be from 1:2 to 9:1. Exemplary linear alkylbenzene sulphonates are $C_{10}$-$C_{16}$ alkyl benzene sulfonic acids, or $C_{11}$-$C_{14}$ alkyl benzene sulfonic acids. By 'linear', it is meant that the alkyl group is linear. The alkyl sulphate anionic surfactant may comprise alkoxylated alkyl sulphate or non-alkoxylated alkyl sulphate or a mixture thereof. The alkoxylated alkyl sulphate anionic surfactant optionally is an ethoxylated alkyl sulphate anionic surfactant. The alkyl sulphate anionic surfactant may comprise an ethoxylated alkyl sulphate anionic surfactant, optionally having a mol average degree of ethoxylation from 1 to 5. The alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5. The alkyl fraction of the alkyl sulphate anionic surfactant can optionally be derived from fatty alcohols, oxo-synthesized alcohols, Guerbet alcohols, or mixtures thereof. Optionally, the non-ionic surfactant can be selected from alcohol alkoxylate, an oxo-synthesized alcohol alkoxylate, Guerbet alcohol alkoxylates, alkyl phenol alcohol alkoxylates, or a mixture thereof.

The laundry detergent composition can comprise between 0.01% and 10% by weight of the liquid laundry detergent composition of a non-ionic surfactant.

Optionally, the laundry detergent composition can comprise between 1.5% and 20% by weight of the laundry detergent composition of soap, optionally a fatty acid salt, optionally an amine neutralized fatty acid salt, wherein optionally the amine is an alkanolamine optionally selected from monoethanolamine, diethanolamine, triethanolamine or a mixture thereof, more optionally monoethanolamine.

Optionally, the laundry detergent composition is a liquid laundry detergent composition, optionally the liquid laundry detergent composition comprises less than 15% by weight of the liquid laundry detergent composition of water.

Optionally, the laundry detergent composition is a liquid laundry detergent composition that can comprise a non-aqueous solvent selected from 1,2-propanediol, dipropylene glycol, tripropyleneglycol, glycerol, sorbitol, polyethylene glycol or a mixture thereof. Optionally, the liquid laundry detergent composition can comprise between 10% and 40% by weight of the liquid laundry detergent composition of the non-aqueous solvent.

Optionally, the laundry detergent composition comprises an adjunct ingredient selected from builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof.

Optionally, the laundry detergent composition has a pH between 6 and 10, wherein the pH of the laundry detergent composition is measured as a 10% product concentration in demineralized water at 20° C. When liquid, the laundry detergent composition may be Newtonian or non-Newtonian. Optionally, the liquid laundry detergent composition is non-Newtonian.

Combinations

An Example is below:

A. A bag (10) comprising:

a first side panel (20) having a pair of first side panel transverse edges (70) and a first side panel interior facing surface (80);

a second side panel (30) opposite said first side panel and having a second side panel interior facing surface (90) facing said first side panel interior facing surface, wherein said second side panel is connected with said first side panel across a bottom (60) of said bag and has a pair of second side panel transverse edges (100), wherein each said first side panel transverse edge is joined to an opposing second side panel transverse edge; and a closure (40) opposite said bottom and extending along a longitudinal axis (L), wherein said closure releasably connects said first side panel and said second side panel, wherein said closure, part of said first side panel interior facing surface, part of said second side panel interior facing surface, and said bottom define an interior volume (50);

wherein said closure comprises:

a first flexible angle (120) extending along said longitudinal axis, wherein said first flexible angle comprises a first interior part (130) joined to said first side panel inside of said interior volume and a first exterior part (140) extending from said first interior part and outside of said interior volume;

a repositionable pressure sensitive adhesive (150) that releasably engages directly or indirectly said first exterior part to said second side panel interior facing surface; and a free flange (160) extending from said first exterior part and along at least a portion of said longitudinal axis, wherein said free flange is devoid of said repositionable pressure sensitive adhesive;

wherein said first side panel and said second side panel are more than about 80% by weight paper.

B. The bag according to Paragraph A, wherein said closure has a closure length along said longitudinal axis wherein said free flange has a free flange length along said longitudinal axis and said free flange length is less than about 20% of said closure length.

C. The bag according to Paragraph A or B, wherein at least a portion of said free flange contrasts in color from said first exterior part.

D. The bag according to any of Paragraphs A to C, wherein said second side panel is continuous with said first side panel across said bottom of said bag.

E. The bag according to any of Paragraphs A to D, wherein said bag is more than about 80% by weight paper.

F. The bag according to any of Paragraphs A to E, wherein said first side panel interior facing surface and said second side panel interior facing surface are coated with a polymeric coating.

G. The bag according to Paragraph F wherein said polymeric coating comprises at least one material selected from low density polyethylene, linear low density polyethylene, high density polyethylene, polypropylene, polyacrylamide, linear polyacrylamide, styrene butadiene copolymer, and combinations thereof.

H. The bag according to any of Paragraphs A to G, wherein said first side panel has a first side panel exterior facing surface (82) opposite said first side panel interior facing surface and said second side panel has a second side panel exterior facing surface (92) opposite said second side panel interior facing surface, wherein said first side panel exterior facing surface and said second side panel exterior facing surface are non-continuously coated or uncoated.

I. The bag according to any of Paragraphs A to H, wherein said repositionable pressure sensitive adhesive includes at least one material selected from acrylic and methacrylic ester homo or copolymers, butyl rubber based systems, silicones, nitriles, styrene block copolymers, ethylene vinyl acetate, urethanes, vinyl esters and amides, olefin copolymer materials, natural or synthetic rubber, and the mixtures thereof.

J. The bag according to any of Paragraphs A to I, wherein said first side panel and said second side panel each have a top edge (11) outside said interior volume, wherein said free flange is recessed relative to said top edges.

K. The bag according to any of Paragraphs A to J, wherein said repositionable pressure sensitive adhesive has a load at failure according to ASTM D3165-07(2014) from about 0.05 to about 0.5 MPa and an average T-peel strength according to ASTM D903-98(2017) from about 0.01 to about 0.6 N/mm L. The bag according to any of Paragraphs A to K, wherein said bag contains a plurality of water-soluble unit dose articles.

M. The bag according to any of Paragraphs A to L, wherein said repositionable pressure sensitive adhesive has a closure height measured orthogonal to said longitudinal axis, wherein said closure height is from about 1 mm to about 50 mm.

N. The bag according to Paragraph A, wherein said bag further comprises a second flexible angle (170) extending along said longitudinal axis, wherein said second flexible angle comprises a second exterior part (180) joined to said second side panel interior facing surface outside of said interior volume and a second interior part (190) extending from said second exterior part and inside said interior volume, wherein said repositionable pressure sensitive adhesive releasably engages said first exterior part to said second interior part to indirectly releasably engage said first exterior part to said second side panel interior facing surface through said second interior part, and wherein said second interior part has a second interior part distal end oriented towards said interior volume.

O. The bag according to Paragraph N, wherein said repositionable pressure sensitive adhesive is on at least one surface selected from said first exterior part and oriented towards said second interior part, said second interior part and oriented towards said first exterior part, and combinations thereof.

P. The bag according to Paragraph N or O, wherein said first flexible angle and said second flexible angle are more than about 80% by weight paper.

Q. The bag according to any of Paragraphs N to P:

wherein said first flexible angle and said second flexible angle each have an outward facing surface (220) wherein said outward facing surfaces are oriented away from one another;

wherein said first side panel interior facing surface, said second side panel interior facing surface, and at least a portion of each said outward facing surface are coated or partially coated with a polymeric coating (225); and wherein said outward facing surface of said first flexible angle is joined to said first side panel interior facing surface by a heat seal (230) of said polymeric coating and said outward facing surface of said second flexible angle is joined to said second side panel interior facing surface by a heat seal of said polymeric coating.

R. The bag according to any of Paragraphs N to Q, wherein said first exterior part is releasably engaged with said second interior part by said repositionable pressure sensitive adhesive over a release zone (152) having a release area, wherein said bag contains a cumulative weight of articles (2), wherein said repositionable pressure sensitive adhesive has a load at failure according to ASTM D3165-07(2014), wherein said load at failure according to ASTM D3165-07(2014) multiplied by the release area is from about 2 to about 500 times, optionally from about 5 to about 300 times, optionally from about 5 to about 100 time, greater than said cumulative weight of said articles.

S. The bag according to any of Paragraphs N to R, wherein said first exterior part is releasably engaged with said second interior part by said repositionable pressure sensitive adhesive over a release zone (152) having a release area, wherein said bag contains a cumulative weight of articles (2), wherein said release area and said mass of articles are provided at a ratio of from about 125 $mm^2$ per 100 g to about 1250 $mm^2$ per 100 g.

T. The bag according to any of Paragraphs N to S, wherein said repositionable pressure sensitive adhesive has a closure height measured orthogonal to said longitudinal axis, wherein said closure height is from about 1 mm to about 50 mm U. A method of opening the bag according to any of Paragraphs N to T comprising the steps of:

grasping said second side panel at a top edge (11) of said second side panel with one hand, wherein said top edge is opposite said bottom and outside said interior volume;

grasping said free flange with another hand; and peeling said free flange and said second side panel away from one another to peel said first exterior part from said second interior part along said repositionable pressure sensitive adhesive to open said bag; and optionally reengaging said first exterior part and said second interior part with one another along said repositionable pressure sensitive adhesive to close said bag.

V. A method of opening the bag according to any of Paragraphs A to M, comprising the steps of:

grasping said second side panel at a top edge (11) of said second side panel with one hand, wherein said top edge is opposite said bottom and outside said interior volume;

grasping said free flange with another hand; and peeling said free flange from said second side panel along said repositionable pressure sensitive adhesive to open said bag; and optionally reengaging said first exterior part and said second side panel with one another along said repositionable pressure sensitive adhesive to close said bag.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A bag comprising:

a first side panel having a pair of first side panel transverse edges and a first side panel interior facing surface;

a second side panel opposite said first side panel and having a second side panel interior facing surface facing said first side panel interior facing surface, wherein said second side panel is connected with said first side panel across a bottom of said bag and has a pair of second side panel transverse edges, wherein each said first side panel transverse edge is joined to an opposing second side panel transverse edge; and a closure opposite said bottom and extending along a longitudinal axis, wherein said closure releasably connects said first side panel and said second side panel, wherein said closure, part of said first side panel interior facing surface, part of said second side panel interior facing surface, and said bottom define an interior volume;

wherein said closure comprises:

a first flexible angle extending along said longitudinal axis, wherein said first flexible angle comprises a first interior part joined to said first side panel inside of said interior volume and a first exterior part extending from said first interior part and outside of said interior volume;

a repositionable pressure sensitive adhesive that releasably engages directly or indirectly said first exterior part to said second side panel interior facing surface; and a free flange extending from said first exterior part and along at least a portion of said longitudinal axis, wherein said free flange is devoid of said repositionable pressure sensitive adhesive;

wherein said first side panel and said second side panel are more than 80% by weight paper; and wherein said repositionable pressure sensitive adhesive has a load at failure according to ASTM D3165-07 (2014) from 0.05 to 0.5 MPa and an average T-peel strength according to ASTM D903-98(2017) from 0.01 to 0.6 N/mm.

2. The bag according to claim 1, wherein said closure has a closure length along said longitudinal axis wherein said free flange has a free flange length along said longitudinal axis and said free flange length is less than 20% of said closure length.

3. The bag according to claim 1, wherein at least a portion of said free flange contrasts in color from said first exterior part.

4. The bag according to claim 1, wherein said second side panel is continuous with said first side panel across said bottom of said bag.

5. The bag according to claim 1, wherein said bag is more than 80% by weight paper.

6. The bag according to claim 1, wherein said first side panel interior facing surface and said second side panel interior facing surface are coated with a polymeric coating.

7. The bag according to claim 1, wherein said repositionable pressure sensitive adhesive includes at least one material selected from acrylic and methacrylic ester homo or copolymers, butyl rubber based systems, silicones, nitriles, styrene block copolymers, ethylene vinyl acetate, urethanes, vinyl esters and amides, olefin copolymer materials, natural or synthetic rubber, and the mixtures thereof.

8. The bag according to claim 1, wherein said first side panel and said second side panel each have a top edge outside said interior volume, wherein said free flange is recessed relative to said top edges.

9. A method of opening the bag according to claim 1, comprising the steps of:

grasping said second side panel at a top edge of said second side panel with one hand, wherein said top edge is opposite said bottom and outside said interior volume;

grasping said free flange with another hand; and peeling said free flange from said second side panel along said repositionable pressure sensitive adhesive to open said bag.

10. The bag according to claim 1, wherein said bag further comprises a second flexible angle extending along said longitudinal axis, wherein said second flexible angle comprises a second exterior part joined to said second side panel interior facing surface outside of said interior volume and a second interior part extending from said second exterior part and inside said interior volume, wherein said repositionable pressure sensitive adhesive releasably engages said first exterior part to said second interior part to indirectly releasably engage said first exterior part to said second side panel interior facing surface through said second interior part, and wherein said second interior part has a second interior part distal end oriented towards said interior volume.

11. The bag according to claim 10, wherein said repositionable pressure sensitive adhesive is on at least one surface selected from said first exterior part and oriented towards said second interior part, said second interior part and oriented towards said first exterior part, and combinations thereof.

12. The bag according to claim 10, wherein said closure has a closure length along said longitudinal axis wherein said free flange has a free flange length along said longitudinal axis and said free flange length is less than 20% of said closure length.

13. The bag according to claim 10, wherein said first flexible angle and said second flexible angle are more than 80% by weight paper.

14. The bag according to claim 10:

wherein said first flexible angle and said second flexible angle each have an outward facing surface wherein said outward facing surfaces are oriented away from one another; wherein said first side panel interior facing surface, said second side panel interior facing surface, and at least a portion of each said outward facing surface are coated or partially coated with a polymeric coating; and wherein said outward facing surface of said first flexible angle is joined to said first side panel interior facing surface by a heat seal of said polymeric coating and said outward facing surface of said second flexible angle is joined to said second side panel interior facing surface by a heat seal of said polymeric coating.

15. The bag according to claim 14, wherein said closure has a closure length along said longitudinal axis wherein said free flange has a free flange length along said longitudinal axis and said free flange length is less than 20% of said closure length.

16. The bag according to claim 14, wherein said first side panel and said second side panel each have a top edge outside said interior volume, wherein said free flange is recessed relative to said top edges.

17. A method of opening the bag according to claim 14 comprising the steps of:

grasping said second side panel at a top edge of said second side panel with one hand, wherein said top edge is opposite said bottom and outside said interior volume;

grasping said free flange with another hand; and peeling said free flange and said second side panel away from one another to peel said first exterior part from said second interior part along said repositionable pressure sensitive adhesive to open said bag.

18. A method of opening the bag according to claim 14 comprising the steps of:

grasping said second side panel at a top edge of said second side panel with one hand, wherein said top edge is opposite said bottom and outside said interior volume;

grasping said free flange with another hand;

peeling said free flange and said second side panel away from one another to peel said first exterior part from said second interior part along said repositionable pressure sensitive adhesive to open said bag; and reengaging said first exterior part and said second interior part with one another along said repositionable pressure sensitive adhesive to close said bag.

19. A method of opening the bag according to claim 1, comprising the steps of:

grasping said second side panel at a top edge of said second side panel with one hand, wherein said top edge is opposite said bottom and outside said interior volume;

grasping said free flange with another hand;

peeling said free flange from said second side panel along said repositionable pressure sensitive adhesive to open said bag; and reengaging said first exterior part and said second side panel with one another along said repositionable pressure sensitive adhesive to close said bag.

20. A bag comprising:

a first side panel having a pair of first side panel transverse edges and a first side panel interior facing surface;

a second side panel opposite said first side panel and having a second side panel interior facing surface facing said first side panel interior facing surface, wherein said second side panel is connected with said first side panel across a bottom of said bag and has a pair of second side panel transverse edges, wherein each said first side panel transverse edge is joined to an opposing second side panel transverse edge; and a closure opposite said bottom and extending along a longitudinal axis, wherein said closure releasably connects said first side panel and said second side panel, wherein said closure, part of said first side panel interior facing surface, part of said second side panel interior facing surface, and said bottom define an interior volume;

wherein said closure comprises:

a first flexible angle extending along said longitudinal axis, wherein said first flexible angle comprises a first interior part joined to said first side panel inside of said interior volume and a first exterior part extending from said first interior part and outside of said interior volume;

a second flexible angle extending along said longitudinal axis, wherein said second flexible angle comprises a second exterior part joined to said second side panel interior facing surface outside of said interior volume and a second interior part extending from said second exterior part and inside said interior volume;

a repositionable pressure sensitive adhesive that releasably engages said first exterior part to said second interior part to indirectly releasably engage said first exterior part to said second side panel interior facing surface through said second interior part over a release zone having a release area, and wherein said second interior part has a second interior part distal end oriented towards said interior volume; and a free flange extending from said first exterior part and along at least a portion of said longitudinal axis, wherein said free flange is devoid of said repositionable pressure sensitive adhesive;

wherein said first side panel and said second side panel are more than 80% by weight paper;

wherein said bag contains a cumulative weight of articles;

wherein said repositionable pressure sensitive adhesive has a load at failure according to ASTM D3165-07 (2014);

wherein said load at failure according to ASTM D3165-07(2014) multiplied by the release area is from about 2 to about 500 times greater than said cumulative weight of said articles.

* * * * *